US006828763B2

(12) United States Patent
Sudou et al.

(10) Patent No.: US 6,828,763 B2
(45) Date of Patent: Dec. 7, 2004

(54) VOLTAGE REGULATOR

(75) Inventors: Minoru Sudou, Chiba (JP); Kenji Kanou, Itami (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/626,450

(22) Filed: Jul. 24, 2003

(65) Prior Publication Data

US 2004/0130306 A1 Jul. 8, 2004

(30) Foreign Application Priority Data

Jul. 26, 2002 (JP) ..... 2002-217758

(51) Int. Cl.[7] ..... G05F 1/613
(52) U.S. Cl. ..... 323/226; 323/273
(58) Field of Search ..... 323/223, 224, 323/226, 266, 273

(56) References Cited

U.S. PATENT DOCUMENTS 5,570,004 A * 10/1996 Shibata ..... 323/303
5,686,820 A * 11/1997 Riggio, Jr. ..... 323/273
6,049,200 A * 4/2000 Hayashimoto ..... 323/269
6,104,179 A * 8/2000 Yukawa ..... 323/316
6,420,857 B2 * 7/2002 Fukui ..... 323/280
6,509,723 B2 * 1/2003 Matsushita ..... 323/281
6,559,626 B2 * 5/2003 Horie ..... 323/282
6,696,822 B2 * 2/2004 Takabayashi ..... 323/224

* cited by examiner

*Primary Examiner*—Adolf Berhane
(74) *Attorney, Agent, or Firm*—Adams & Wilks

(57) ABSTRACT

A voltage regulator comprises a differential amplifier for comparing an output of a reference voltage circuit with an output of a voltage dividing circuit and outputting a first signal and a phase compensating circuit having a resistor and a capacitor connected in series. A MOS transistor is connected between a power supply and the phase compensating circuit and has a gate electrode connected to receive the output of the differential amplifier and a grounded source. A constant current circuit is connected between the MOS transistor and ground, and an output transistor having a gate electrode connected to receive a second signal output from a connection point between the MOS transistor and the phase compensating circuit is connected between the power supply and the voltage dividing circuit. A resistor side of the phase compensating circuit is connected to an output terminal of the differential amplifier and a capacitor side of the phase compensating circuit is connected to a drain electrode of the MOS transistor.

4 Claims, 3 Drawing Sheets

VOLTAGE REGULATOR

BACKGROUND OF THE INVENTION

1. Field of the Invention

The present invention relates a voltage regulator (hereinafter referred to as a V/R) capable of achieving an improvement in response property of the V/R and of stably operating with a small output capacitance.

2. Description of the Related Art

According to the conventional V/R, as described in JP 04-195613 A, the V/R is composed of an error amplifier with a single stage voltage amplification. In other words, the conventional V/R has a circuit as shown in FIG. 5. The V/R is composed of: an error amplifier 13 for amplifying a differential voltage between a reference voltage of a reference voltage circuit 10 and a voltage at a connection point of bleeder resistors 11 and 12 that divides an output voltage Vout of the V/R; and an output transistor 14. When an output voltage of the error amplifier 13 is given by Verr, an output voltage of the reference voltage circuit 10 is given by Vref, and the voltage at the connection point of bleeder resistors 11 and 12 is given by Va, if Vref>Va is established, Verr becomes lower. On the other hand, if Vref≦Va is established, Verr becomes higher.

If Verr becomes lower, because the output transistor 14 is a P-ch MOS transistor in this case, a voltage between the gate and the source becomes larger and an ON resistance becomes smaller, with the result that the V/R functions to rise the output voltage Vout. On the other hand, if Verr becomes higher, the V/R functions to increase the ON resistance of the output transistor 14 and to reduce the output voltage, thereby keeping the output voltage Vout at a fixed value.

In the case of the conventional V/R, because the error amplifier 13 is a single stage voltage amplifying circuit, a two-stage voltage amplification structure is obtained by using such a circuit and a voltage amplification stage which is composed of the output transistor 14 and a load 25. A phase compensating capacitor 15 is connected between the output of the error amplifier 13 and the drain of the output transistor 14. A frequency band of the error amplifier 13 is narrowed by a mirror effect, thereby preventing oscillation of the V/R. Consequently, since the frequency band of the entire V/R becomes narrower, the response property of the V/R is deteriorated.

In general, when the response property of the V/R is improved, it is necessary to widen the frequency band of the entire V/R. However, when the frequency band of the entire V/R is widened, it is necessary to increase a consumption current of the voltage amplifying circuit. In particular, when the V/R is used for a battery of a portable device or the like, its operating time becomes shorter.

Also, when a three-stage voltage amplification is used, even if a consumption current is relatively small, the frequency band of the V/R can be widened. However, because a phase is easily delayed by 180 degrees or more, the operation of the V/R becomes unstable, causing oscillation thereof in the worst case. Therefore, in the case of the three-stage voltage amplification, it is required to return the phase at a zero point resulting from the load and an ESR (equivalent series resistance) of the capacitor. Note that, when the ESR is very small as in a ceramic capacitor, in order to reduce a frequency at the zero point, it is necessary to increase a capacitance value of the ceramic capacitor.

In the conventional V/R, in order to ensure the stability against oscillation, it is required to narrow the frequency band. Accordingly, there is a problem in that the response property is deteriorated. In addition, when the response property is improved, the consumption current is increased and the stability is deteriorated, so that a large capacitance is required for the output of the V/R.

SUMMARY OF THE INVENTION

Therefore, in order to solve the above-mentioned conventional problems, an object of the present invention is to obtain a V/R which has a preferable response property with a small consumption current and is stably operated with a small output capacitance.

A voltage regulator according to the present invention includes: a reference voltage circuit connected between a power supply and a ground; voltage dividing circuit for dividing an output voltage supplied to an external load, which is composed of a bleeder resistor; and a differential amplifier for comparing an output of the reference voltage circuit with an output of the voltage dividing circuit and outputting a first signal. The voltage regulator further includes: a phase compensating circuit in which a resistor and a capacitor are connected in series; a MOS transistor in which an output of the differential amplifier is inputted to a gate electrode, which is connected between the power supply and the phase compensating circuit, and in which a source is grounded; a constant current circuit connected between the MOS transistor and the ground; and an output transistor in which a second signal from a connection point between the MOS transistor and the phase compensating circuit is inputted to a gate electrode and which is connected between the power supply and the voltage dividing circuit. Further, a resistor side of the phase compensating circuit is connected with an output terminal of the differential amplifier and a capacitor side of the phase compensating circuit is connected with a drain electrode of the MOS transistor. In addition, the output voltage is outputted from a connection point between the output transistor and the voltage dividing circuit.

The voltage regulator according to the present invention is characterized in that a value of the capacitor is equal to or larger than a gate capacitance value of the output transistor.

The voltage regulator according to the present invention is characterized in that a value of the resistor is equal to or larger than 20 kΩ and the value of the capacitor is equal to or larger than 10 pF.

DETAILED DESCRIPTION OF THE PREFERRED EMBODIMENT(S)

A two-stage voltage amplification is used as an error amplifier of a V/R. A resistor and a capacitor which are used for phase compensation are inserted between a first output stage and a second output stage, and a zero point resulting from the resistor and the capacitor is generated at a low frequency, so that the V/R has a preferable response property and is stably operated even with a small output capacitance.

Embodiment

Figure 1:
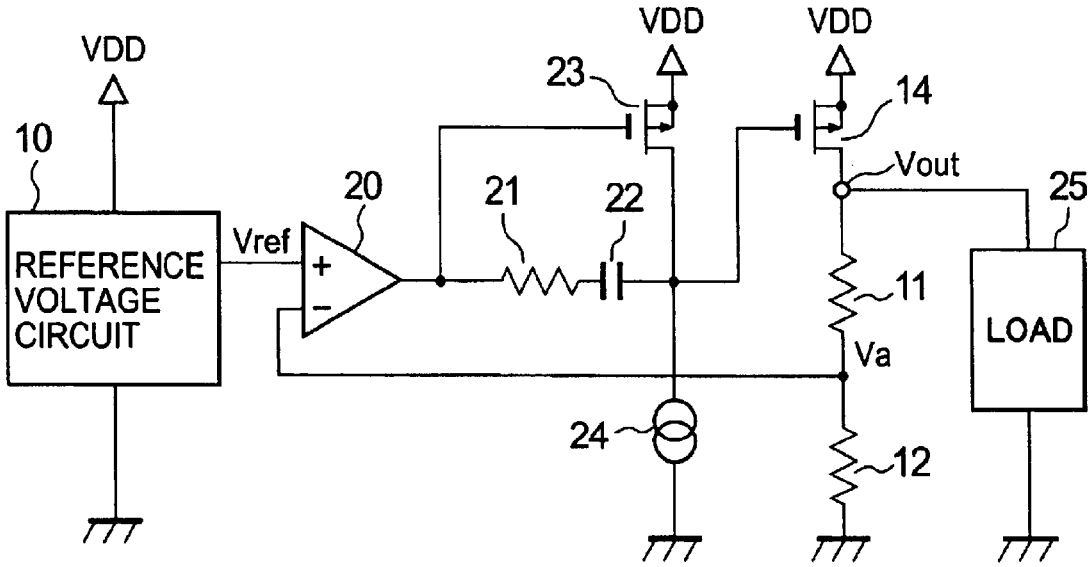
FIG. 1 is an explanatory diagram of a V/R circuit of an embodiment of the present invention.

Hereinafter, an embodiment of the present invention will be described with reference to the drawings. FIG. 1 is a V/R circuit diagram showing an embodiment of the present invention. A reference voltage circuit 10, bleeder resistors 11 and 12, an output transistor 14, and a load 25 are the same as in the conventional case.

A differential amplifying circuit 20 is a single stage voltage amplifying circuit and the output terminal thereof is connected with the gate of a MOS transistor 23 composing a common source amplifying circuit and a resistor side as one terminal of a phase compensating circuit which is composed of a resistor 21 and a capacitor 22. The transistor 23 is constant current-driven by a constant current circuit 24. An output terminal of the common source amplifying circuit is connected with the other terminal of the phase compensating circuit and the gate of the output transistor 14.

In other words, an error amplifying circuit includes: a two-stage voltage amplifying circuit which has the differential amplifying circuit 20 and the common source amplifying circuit composed of the transistor 23; and the phase compensating circuit which is composed of the resistor 21 and the capacitor 22. The output of the error amplifying circuit is amplified by a common source amplifying circuit which is composed of the output transistor 14 and the load 25. Therefore, the V/R becomes a three-stage voltage amplifying circuit.

Because the V/R is formed as the three-stage voltage amplifying circuit, a GB product can be increased even in a low consumption current and response property of the V/R can be improved. However, in the case of the three-stage voltage amplifying circuit, a phase is easily delayed by 180 degrees or more, which readily causes oscillation.

Therefore, in order to prevent the oscillation, the phase is returned at the zero point resulting from the resistor 21 and the capacitor 22.

Figure 2:
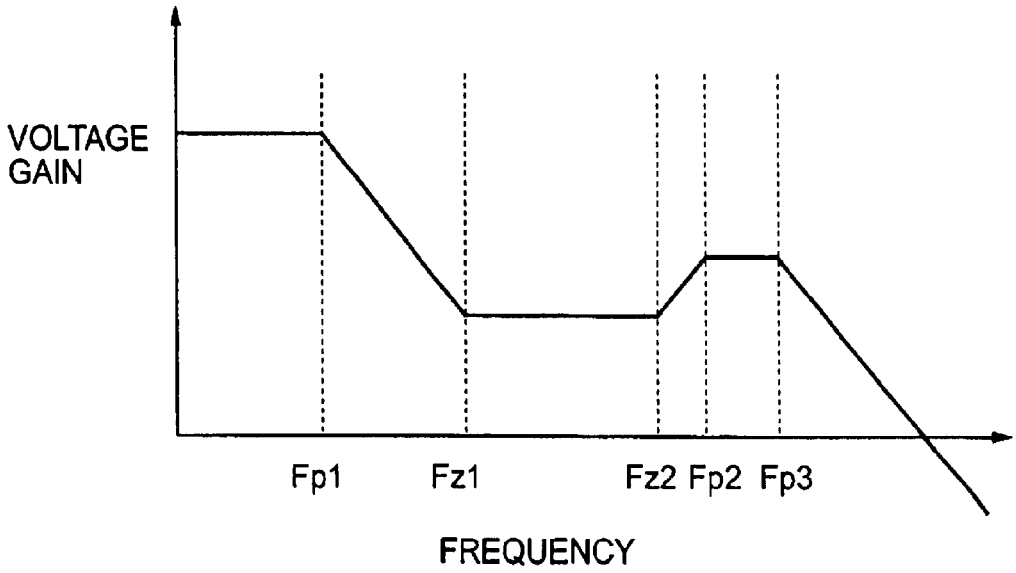
FIG. 2 shows gain-frequency characteristics of a differential amplifying circuit of the present invention.

FIG. 2 shows an example of frequency characteristics of a voltage gain of the differential amplifying circuit 20 in the circuit shown in FIG. 1. In FIG. 2, the logarithm of a frequency is taken along the abscissa and the decibel of the voltage gain is taken along the ordinate. A first pole is present at a minimum frequency. Hereinafter, the pole is referred to as a 1st pole and its frequency is given by Fp1.

From the frequency Fp1, the voltage gain is attenuated at −6 dB/oct and a phase begins to delay by 90 degrees. A first zero point is present at a frequency increased from the frequency Fp1. Hereinafter, the point is referred to as a 1st zero point and its frequency is given by Fz1.

From the frequency Fz1, the voltage gain becomes constant with respect to a frequency. Because the phase leads by 90 degrees by the zero point, the phase delay becomes zero again. A second zero point is present at a frequency increased from the frequency Fz1. Hereinafter, this is referred to as a 2nd zero point and its frequency is given by Fz2.

From the frequency Fz2, the voltage gain is increased at +6 dB/oct with respect to a frequency. Because the phase leads by 90 degrees by the zero point, the phase begins to lead by 90 degrees. Second and third poles are present in frequencies increased from the frequency Fz2, Hereinafter, the poles are referred to as a 2nd pole and a 3rd pole and their frequencies are given by Fp2 and Fp3.

From the frequency Fp2, the voltage gain becomes constant with respect to a frequency. Because the phase is delayed by 90 degrees by the poles, a phase leading becomes zero.

Further, from the frequency Fp3, the voltage gain is attenuated at −6 dB/oct with respect to a frequency and the phase begins to delay by 90 degrees.

In FIG. 2, an expression (1) is established with respect to a relationship of the respective frequencies.

$$Fp1<Fz1<Fz2<Fp2<Fp3 \quad (1)$$

In other words, the frequency Fz1 of the 1st zero point and the frequency Fz2 of the 2nd zero point, which are lower than the frequency Fp2 of the 2nd pole, are present. Therefore, the phase delay is cancelled in a range of the frequency Fz1 to the frequency Fz2 and the phase leads by 90 degrees in maximum in the range of the frequency Fz1 to the frequency Fz2. Further, the phase delay and phase leading are not caused in a range of the frequency Fz2 to the frequency Fp2. From a frequency Fp3, the phase begins to delay by 90 degrees.

Thus, when the frequency characteristics of the differential amplifying circuit is set as described above, the phase delay is not caused in the range of the frequency Fz1 to the frequency Fp3, thereby the phase preferably leads. Thus, the stability of the entire V/R can be improved.

In the common source amplifying circuit composed of the transistor 23 as shown in FIG. 1, a pole is present at a frequency determined according to a node capacitance of the drain of the transistor 23 and an output resistance of the transistor 23. Its frequency is given by Fp2nd. In addition, in the common source amplifying circuit which is composed of the output transistor 14 and the load 25 as shown in FIG. 1, a pole is present at a frequency determined according to a resistance and a capacitance of the load 25. Its frequency is given by Fp3rd.

In both amplifying circuits, with respect to the frequencies of Fp2nd and Fp3rd, the voltage gain begins to attenuate at −6 dB/oct with respect to a frequency and the phase begins to delay by 90 degrees. Because the two poles are present, the phase is delayed by 180 degrees in total. When both Fp2nd and Fp3rd are lower than Fp2, the phase is returned by the 2nd zero point at the frequency Fz2. Therefore, when the voltage gain of the entire V/R becomes 0 at a frequency higher than the frequency Fp2, a phase margin is produced without fail, so that the V/R can be stably operated without causing oscillation.

Figure 3:
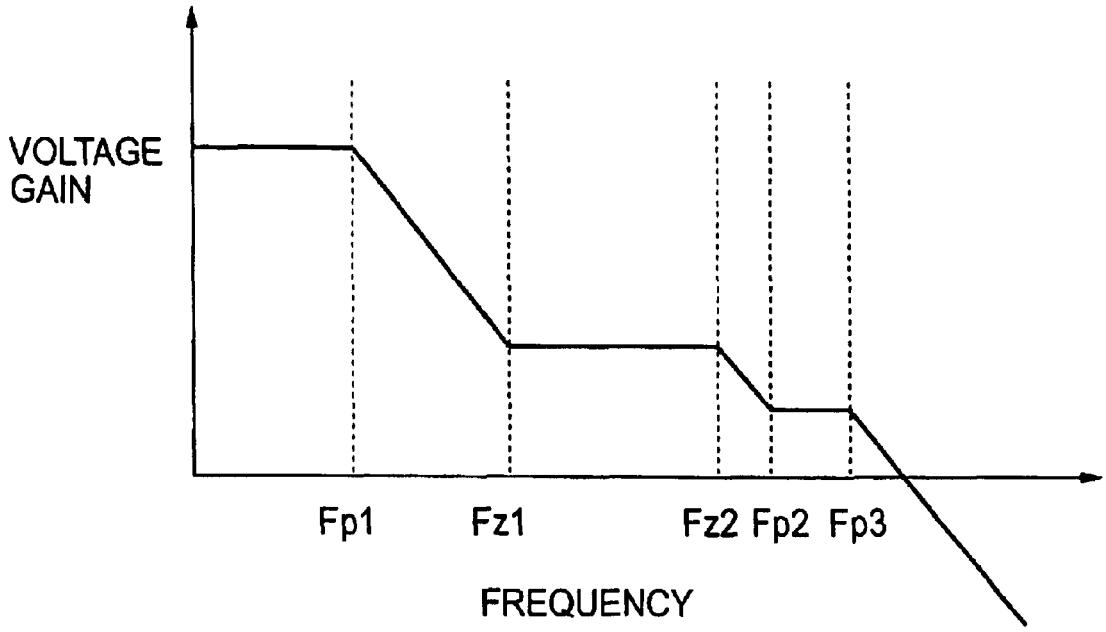
FIG. 3 shows the gain-frequency characteristics of the differential amplifying circuit to which phase compensation is not suitable.

If the frequency Fp2 of the 2nd pole is lower than the frequency Fz2 of the 2nd zero point as shown in FIG. 3 in the frequency characteristics of the voltage gain of the differential amplifying circuit, the phase is delayed by 90 degrees in maximum in a range of the frequency Fp2 to the frequency Fz2, Therefore, because the phase is delayed by 180 degrees by Fp2nd and Fp3rd which are described above, the phase is delayed by 180 degrees or more in the entire V/R, and the V/R is not stably operated.

Figure 4:
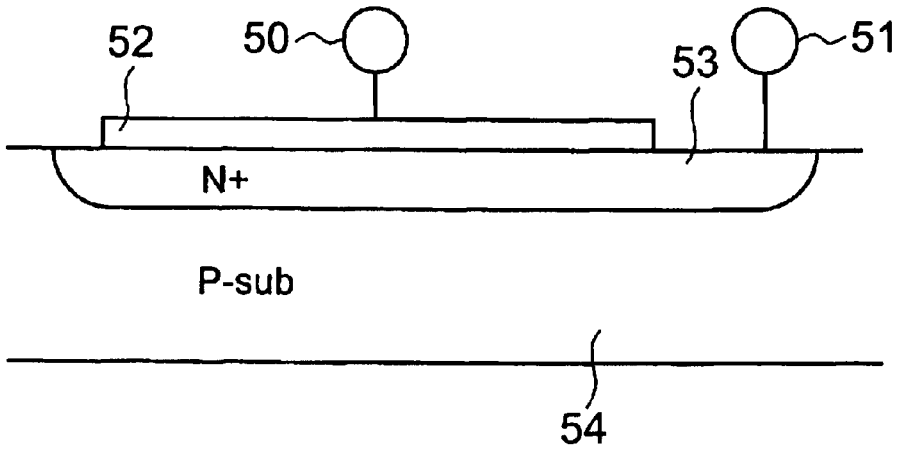
FIG. 4 is an explanatory view of a sectional structure of a capacitor.
Figure 5:
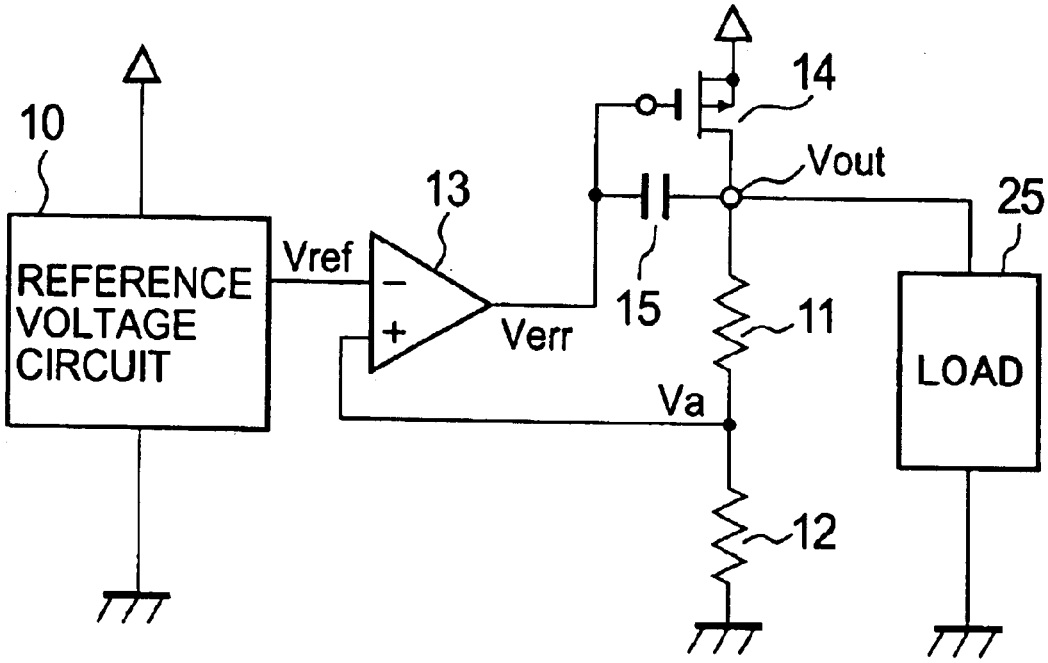
FIG. 5 PRIOR ART
FIG. 5 is an explanatory diagram of a conventional V/R circuit.

Next, the resistor 21 and the capacitor 22 which compose the phase compensating circuit shown in FIG. 1 will be described. FIG. 4 is a sectional view when a capacitor is formed in an integrated circuit. FIG. 4 shows an example in which the capacitor is formed on a P-type substrate. An impurity diffusion layer 53 of an N-type opposite to a P-type is formed in a P-type substrate 54 and a thin oxide film 52 is formed thereon. An electrode 50 is formed on the oxide film 52 and an electrode 51 is formed on the N-type impurity diffusion layer 53, so that a capacitor using the oxide film 52 is formed between the electrodes 50 and 51. In the case of the P-type substrate, because a potential of the P-type substrate is generally connected with a minimum potential of the integrated circuit, the N-type impurity diffusion layer 53 is always insulated from the P-type substrate 54. Here, a PN junction capacitor is present between the N-type impurity diffusion layer 53 and the P-type substrate 54. Accordingly, a parasitic capacitor is connected with the electrode 51 on the N-type impurity diffusion layer, which is produced between the electrode 51 and the P-type substrate. A value of the parasitic capacitor generally becomes about 1% to 20% of a value of the capacitor using the oxide film 52.

If the connection between the resistance 21 and the capacitor 22 which compose the phase compensating circuit shown in FIG. 1 is made reverse to connect the capacitor 22 with the differential amplifying circuit side, a new pole is generated by a parasitic capacitor of the capacitor 22 in the frequency characteristics of the voltage gain of the differential amplifying circuit 20. The V/R is not stably operated.

Therefore, with respect to the connection between the resistance 21 and the capacitor 22 which compose the phase compensating circuit, the resistor 21 is necessarily connected with the output terminal of the differential amplifying circuit. In addition, the electrode connected with the parasitic capacitor of the capacitor 22 which is produced between the capacitor 22 and the substrate is connected with the drain of the transistor 23. According to such connection, the phase compensating circuit can minimize the influence of the parasitic capacitor of the capacitor 22. Because the drain of the transistor 23 is connected with the gate of the output transistor 14, the influence of the parasitic capacitor of the capacitor 22 is smaller than that of the gate capacitor.

Next, the frequency Fp2 of the 2nd pole and the frequency Fz2 of the 2nd zero point will be described. If an output impedance of the constant current circuit 24 is infinite, the frequency Fp2 of the 2nd pole is substantially determined according to the output impedance of the transistor 23 and the node capacitance of the drain of the transistor 23, that is, the gate capacitance of the output transistor 14.

Also, the frequency Fz2 of the 2nd zero point is substantially determined according to the value of the resistor 21 and the value of the capacitor 22. As described above, when the V/R is stably operated, it is necessary to hold the relationship of Fz2 <Fp2.

When the value of the resistor 21 is given by R21 and the value of the capacitor 22 is given by C22, the frequency Fz2 of the zero point resulting from the resistor and the capacitor is indicated by an expression (2), $$Fz2=1/(2\cdot\pi\cdot C22\cdot R21) \quad (2)$$

Here, when Fz2 is set to a frequency lower than Fp2, it is necessary to increase the value of the resistor and the value of the capacitor. However, when a large capacitor is formed in the integrated circuit, a large area is required. Therefore, in a case where the same zero point frequency is produced from the resistor and the capacitor, when the value of the resistor is maximized, it is superior in view of area. On the other hand, the value of the capacitor 22 is reduced, the frequency Fp1 of the 1st pole and the frequency Fz1 of the 1st zero point are each shifted to a high frequency in FIG. 2.

Here, because it is required that Fz1 is lower than Fp2nd and Fp3rd, the value of the capacitor 22 cannot be set to a too small value. From such relation, it is desirable that the value of the resistor 21 is set to 20 kΩ or more.

Also, if the value of the resistor 21 is set to a value nearly equal to the output impedance of the transistor 23, it is necessary to set the value of the capacitor 22 to a value larger than the gate capacitance of the output transistor 14 in order to satisfy Fz2<Fp2.

The value of the gate capacitance of the output transistor 14 is greatly changed according to the characteristic of the V/R, in particular, a current value treated in the V/R. In many cases, the value the gate capacitance becomes 10 pF or more in a general CMOS-integrated V/R. In other words, it is desirable that the value of the capacitor 22 is 10 pF or more.

The V/R of the present invention is constructed by the three-stage amplifying circuit. When the phase compensation of the differential amplifying circuit is suitably conducted, there is an effect that a high speed response property of the V/R is realized in a low consumption current and the V/R can be stably operated in a small output capacitance.

What is claimed is:

1. A voltage regulator comprising:

a reference voltage circuit connected between a power supply and a ground;

a voltage dividing circuit for dividing an output voltage supplied to an external load, which is composed of a bleeder resistor;

a differential amplifier for comparing an output of the reference voltage circuit with an output of the voltage dividing circuit and outputting a first signal;

a phase compensating circuit in which a resistor and a capacitor are connected in series;

a MOS transistor in which an output of the differential amplifier is inputted to a gate electrode, which is connected between the power supply and the phase compensating circuit, and in which a source is grounded;

a constant current circuit connected between the MOS transistor and the ground; and an output transistor in which a second signal output from a connection point between the MOS transistor and the phase compensating circuit is inputted to a gate electrode, and which is connected between the power supply and the voltage dividing circuit, wherein the output voltage is outputted from a connection point between the output transistor and the voltage dividing circuit.

2. A voltage regulator according to claim 1, wherein a resistor side of the phase compensating circuit is connected with an output terminal of the differential amplifier and a capacitor side of the phase compensating circuit is connected with a drain electrode of the MOS transistor.

3. A voltage regulator according to claim 2, wherein a value of the capacitor is equal to or larger than a gate capacitance value of the output transistor.

4. A voltage regulator according to claim 3, wherein a value of the resistor is equal to or larger than 20 kΩ and the value of the capacitor is equal to or larger than 10 pF.

* * * * *